United States Patent [19]

Williams

[11] Patent Number: 4,658,964

[45] Date of Patent: Apr. 21, 1987

[54] ROTARY DISC SCREEN AND METHOD OF OPERATION

[75] Inventor: Robert M. Williams, Ladue, Mo.

[73] Assignee: Williams Patent Crusher and Pulverizer Company, St. Louis, Mo.

[21] Appl. No.: 772,041

[22] Filed: Sep. 3, 1985

[51] Int. Cl.[4] ..... B07C 5/00; B07B 13/04

[52] U.S. Cl. ..... 209/552; 209/672

[58] Field of Search ..... 209/671, 672, 552, 546, 209/361, 667, 668, 615, 616, 621, 673, 1, 237; 364/502

[56] References Cited

U.S. PATENT DOCUMENTS

| | | | |
|---|---|---|---|
| 622,035 | 3/1899 | Bray . | |
| 2,743,813 | 5/1956 | Erickson | 209/671 |
| 2,966,267 | 12/1960 | Dunbar | 209/271 |
| 2,974,793 | 3/1961 | Kuntz | 209/671 |
| 2,997,175 | 8/1961 | Gordon | 198/505 |
| 3,028,957 | 4/1962 | Conway et al. | 209/671 |
| 3,606,745 | 9/1971 | Girodat | 209/1 |
| 4,037,723 | 7/1977 | Wahl et al. | 209/671 |
| 4,266,676 | 5/1981 | Ruckstuhl et al. | 209/672 |
| 4,301,930 | 11/1981 | Smith | 209/671 |
| 4,452,694 | 6/1984 | Christensen et al. | 209/672 |

*Primary Examiner*—Robert B. Reeves
*Assistant Examiner*—Donald T. Hajec
*Attorney, Agent, or Firm*—Gravely, Lieder & Woodruff

[57] ABSTRACT

A rotary disc screen composed of a bed of rotary discs in spaced relation and formed in the periphery with undulating surfaces for constantly agitating the waste material to be screened, and having a controllable drive system for the rotary discs subject to control sensor which is sensitive to the distribution of the waste material along the length of the rotary screen for adjusting the speed of the discs making up the rotary screen to control the residence time of waste material and maximizing the screening efficiency so that certain classes of components in the waste material are given an opportunity to fall through the spaces between the discs for collection and transport to a separate area from the remainder of the waste material that is moved through the full length of the rotary disc screen.

4 Claims, 4 Drawing Figures

ROTARY DISC SCREEN AND METHOD OF OPERATION

BACKGROUND OF THE INVENTION

1. Field of the Invention

The present invention is directed to a rotary disc screen for separating loose material, such as glass and similar refuse from waste material that has a high percentage of burnables, and to the method of its operation.

2. Description of the Prior Art

The art of separating material of differing properties, or of classifying materials by rotary screening apparatus is represented by prior art devices such as disclosed in patents to Bray U.S. Pat. No. 622,035 of Mar. 28, 1899, Erickson U.S. Pat. No. 2,743,813 of May 1, 1956, Dunbar U.S. Pat. No. 2,966,267 of Dec. 27, 1960, Kuntz U.S. Pat. No. 2,974,793 of Mar. 14, 1961, and Conway et al U.S. Pat. No. 3,028,957 of Apr. 10, 1962. These patents may be considered to be the forerunners of more sophisticated apparatus having greater capacity for separating or classifying loose materials.

The more recent prior art includes the Disk Separator U.S. Pat. No. 4,037,723 of Wahl et al of July 26, 1977 for separating finer components of material requiring separation from coarse components. The disks are toothed to facilitate moving large objects. The Apparatus For Separation Of Material Of Heterogeneous Character U.S. Pat. No. 4,266,676 of Ruckstuhl of May 12, 1981 handles municipal refuse which is a mixture of various sizes of material that also vary in weight in which discs are non-circular of the ellipical class. The art also includes U.S. Pat. No. 4,301,930 of Smith of Nov. 24, 1981 for a Disk Screen With Modular Assembly and Method for use in the paper pulp industry for screening wood chips.

None of the foregoing devices have recognized a problem of overcoming non-uniform output, that is to say the output may at times be copious and at other times lean. When a copious output reaches the rotary screen it tends to pile up at the screen inlet which clogs the screen and poor results occur. The foregoing problem has been handled by an attendant being stationed at the rotary screen to regulate the speed of rotation of the screen discs so that a more even distribution of the waste material can be achieved. Manual speed regulation is not a satisfactory answer to the problem of obtaining an efficient result from a rotary disc device for screening waste material.

BRIEF DESCRIPTION OF THE INVENTION

The primary objects of the present invention are to provide a rotary disc screen with rotors having peripheral lobes for agitating the waste material, and to provide automatic means for controlling the distribution of the material along the length of the screen by adjusting the speed of the discs of the screen for evening the fall out, and to provide a drive system that optimizes the ability of the screen to handle most loading conditions.

In a preferred arrangement for carrying out the objects of the present invention the frame of the screen supports a plurality of shafts on each of which a plurality of discs are secured in substantially evenly spaced relationship with the discs of adjacent shafts in intedigitated relationship. The shafts are interconnected by a chain drive system which is responsive to control means for varying the speed of rotation of the shafts to govern the residence time of the waste material between its delivery onto the screen and its discharge. The control means include sound sensing or optical sensors or counter devices, and whichever sensor is employed it will transmit a signal to a microcomputer which governs the speed response of the motor driving the shafts such that the fallout distribution will be more evenly distributed along the length of the screen, thereby maximizing the efficiency ot screening out the class of components that are intended to fall through the spaces in the screen.

BRIEF DESCRIPTION OF THE DRAWINGS

The present rotary disc screen is illustrated in a presently preferred embodiment, wherein.

DETAILED DESCRIPTION OF THE EMBODIMENT

Figure 1:
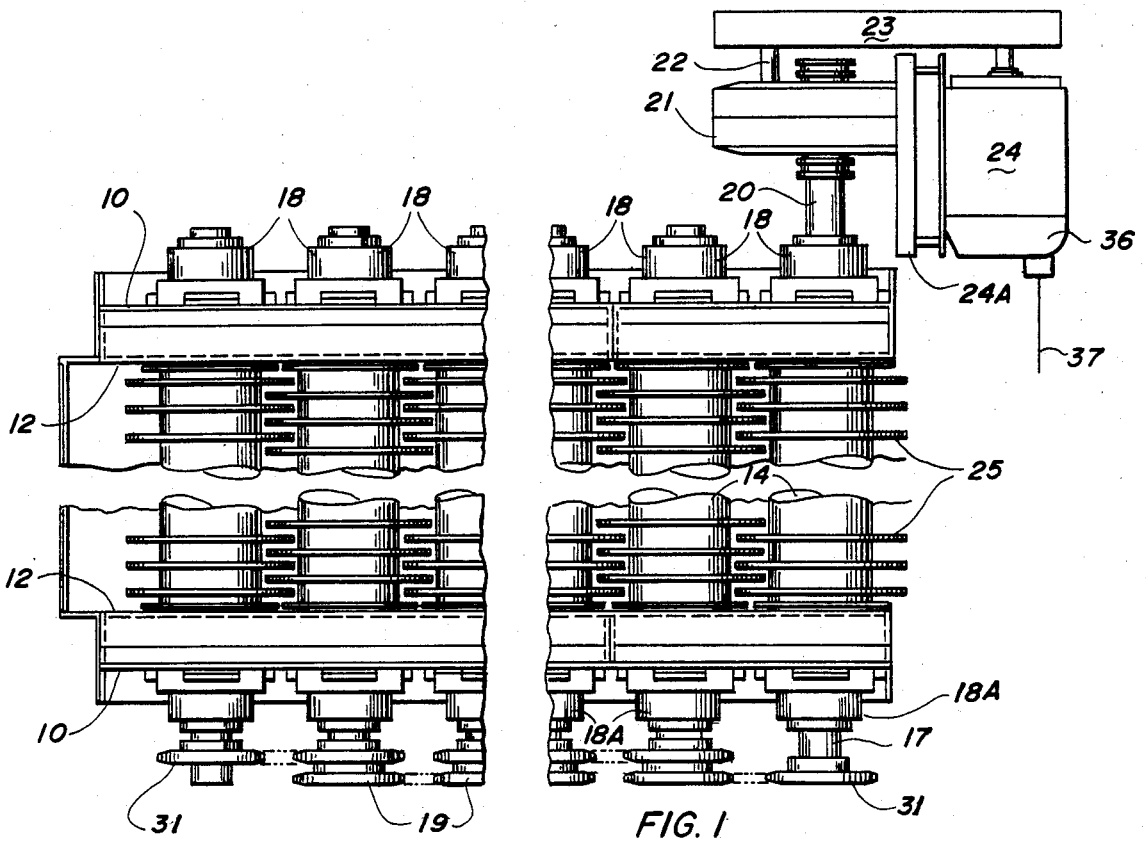
FIG. 1 is a fragmentary plan view of a rotary disc screen exhibiting the general arrangement of the components.
Figure 2:
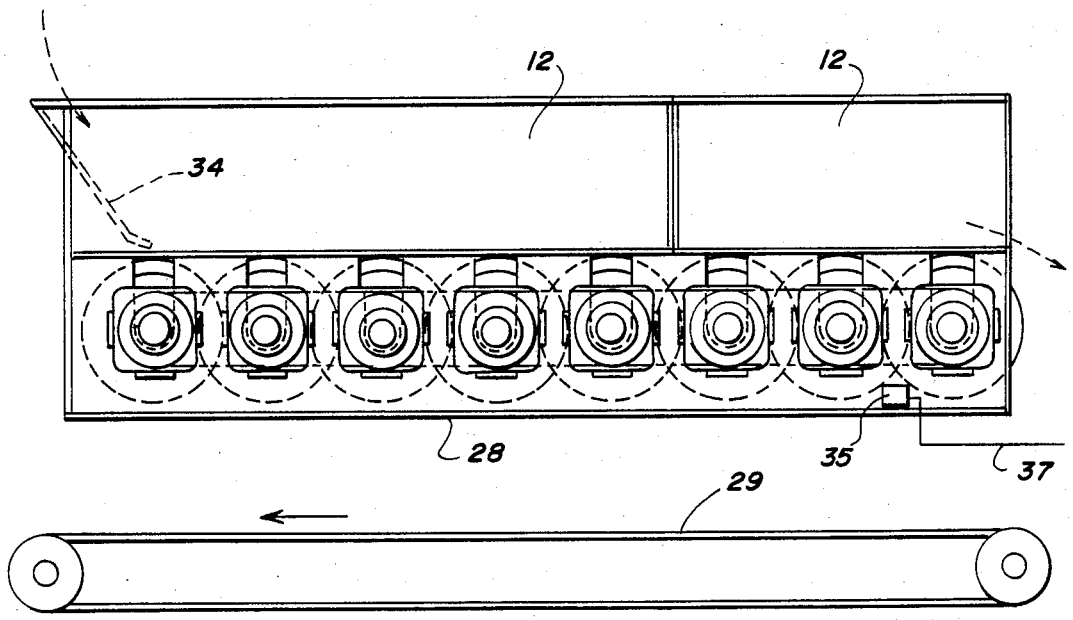
FIG. 2 is a longitudinal elevational view of the rotary disc screen as seen along line 2—2 in FIG. 1.
Figure 3:
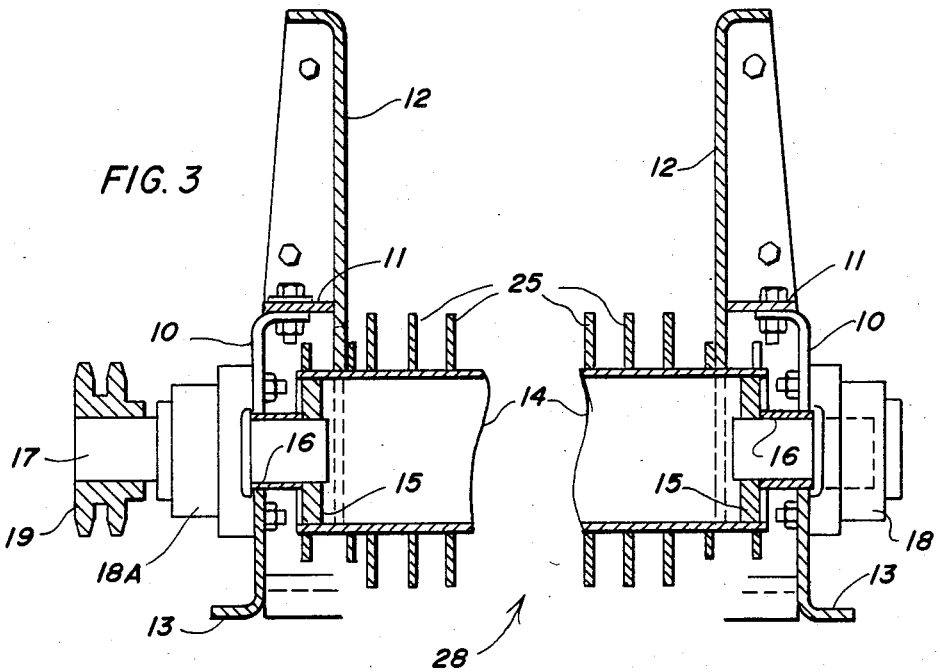
FIG. 3 is a transverse sectional view of the mounting and drive arrangement of a typical shaft for a complement of rotary discs and side walls.

In the drawings there is seen in FIGS. 1, 2 and 3, a general view of the rotary disc screen in plan and in elevation respectively. The screen is composed of a bed frame having longitudinal sides 10 of Z section (FIG. 3) in which the upper inturned flanges 11 support material guide walls 12, and the lower out-turned flanges 13 define the longitudinal margins of the open bottom of the screen. A series of spaced apart and parallel tubular shafts 14 span the distance between the guide walls 12 and project beyond where heavy duty bearing discs 15 are secured in the ends of the shaft 14 so as to be positioned to receive sleeves 16. The sleeves 16 engage over stub shafts 17 mounted in bearing housings 18. The bearing housings 18 are spaced along the outside of the Z section sides 10 and the housings 18A along one of the sides (the left side) are open to allow the shafts 17 to extend out so the chain sprocket 19 can be secured for the purpose of driving the shafts 14. As seen in FIG. 1 a bearing housing 18 near the outlet end of the screen is open to allow the positioning of drive shaft 20 to extend to a speed reducer device 21. Power input to the reducer device 21 is through the shaft 22 of a belt drive mounted in housing 23 which is associated with the electric motor 24 attached to a suitable bracket 24A. This drive arrangement is such that the 1800 RPM of motor 24 operates the drive shaft 20 in the range of from about 60 RPM to about 90 RPM.

Figure 4:
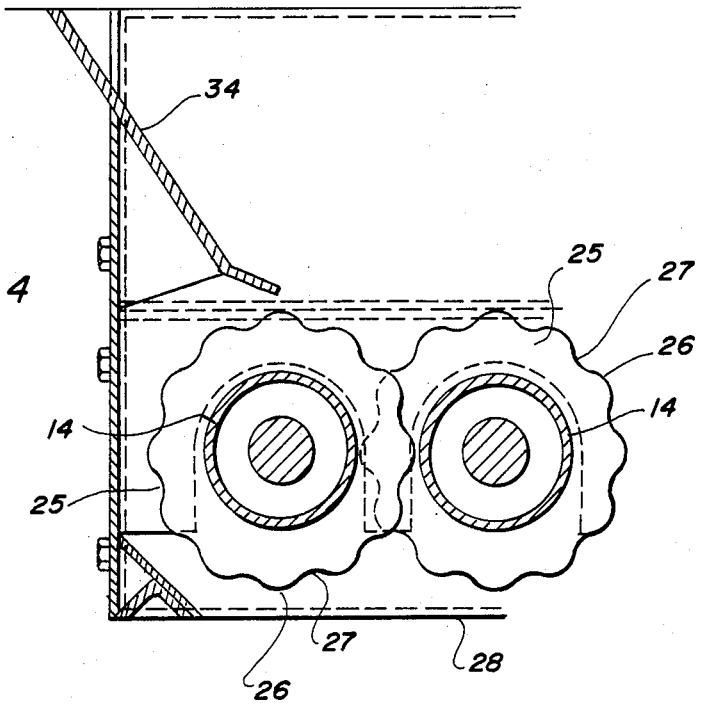
FIG. 4 is a fragmentary sectional view adjacent the inlet end of the rotary disc screen showing typical disc profiles.

The view of FIG. 4 is a disclosure of the typical peripheral profile of discs 25 which are secured on the tubular shafts 14. The profile shows an undulating surface with peaks 26 and valleys 27. This profile shows an undulating surface with peaks 26 and valleys 27. This profile is effective to cause the layer of waste material to rise and fall wherebythe class of smaller and heavier components are worked through the material and fall through the bottom opening 28. As seen in FIG. 2 the fallout components are intercepted by a belt conveyor 29 of any known character and moved to a place of collection for disposal.

The screen drive arrangement is seen in FIGS. 1 and 2, and attention is directed to FIG. 1 where the drive shaft 20 enters bearing housing 18 and is connected to the tubular shaft 14. The opposite end of shaft 14 is carried in a modified housing 18A which allows the shaft 17 to project through to receive chain sprocket 31. The sprocket 31 is secured in position to drive double sprockets 32 in succession, and the drive chains (not shown) end with the last single sprocket 31. It is recognized that several drive chains (not shown) are employed so that all tubular shafts 14 are rotated together to move the material from the inlet feed chute 34 (FIG. 2) to the run off at the tubular shaft 14 at the opposite end. The material entering at chute 34 is retained on the array of discs 25 by the side walls 12.

It has been determined that an efficient operation of the rotary disc screen is obtained when the material to be treated is distributed over the length of the screen rather than to allow it to pile up at the inlet end which will occur if the speed of disc rotation is too slow. The pile up problem is overcome by locating a suitable sensor device 35 adjacent the discharge end of the screen so it can respond to the presence of fallout material and indicate when such material has reached the discharge end. The sensor 35 is connected to a microcomputer 36 by a lead 37 (see FIGS. 1 and 2). The microcomputer is programmed to allow the drive motor 24 to operate the shafts 14 at the upper speed range of about 90 RPM until the sensor 35 generates a signal that fallout material is present. When the signal is generated by sensor 35, the microcomputer 36 will reduce the shaft speed progressively or in response to the volume of fallout material being sensed so that the material delivered at the inlet and caused to travel over the discs will have a residence time sufficient to accomplish the separation function of the screen. It is a feature of the present screen to shape the periphery of the discs so the material will be caused to undulate and be stirred so the heavy particles and the small particles will work their way through the screen and fall onto the conveyor belt 29. The sensor 35 which is preferred is a SONAC sonic sensing device made by Delaware Corporation of Wisconsin.

The foregoing described apparatus performs a method of separating out of a mixed or dissimilar (heterogenous) collection of waste material a class of components that include glass, heavy particles such as rocks and metallic things. The practice of the method is carried out by providing a rotary screen of the foregoing character to support the collection of waste material, introducing the collection of waste material to the rotary screen, driving the rotary screen to move the collection of waste material so the foregoing designated class of components falls out through the screen; sensing when the fallout of the class of components separately from the remainder of the collection of waste material reaches the location of the sensor 35 so the speed of rotation of the discs 25 can be adjusted to spread out the waste material substantially uniformly for maximizing the efficiency of the screen, and collecting the fallout for movement to a place for disposal. For example, if the sensor 35 fails to pick up the fall of components it will increase the speed of the motor 24 until it senses the fall of components. Should the fall of such components increase in sonic volume the sensor 35 will slow the motor 24 on the assumption that too great a mass of the waste material has been moved closer to the exit and residence time is too short for efficient separation.

It will be understood that modifications may come to mind from an understanding of the foregoing disclosure.

What is claimed is:

1. A rotary disc screen comprising:

(a) a bed frame having longitudinal sides in parallel spaced relation extending from a material inlet end to a material outlet end;

(b) rotary shafts rotatably carried by and between said frame sides and arranged in spaced parallel relations;

(c) a series of screen discs secured to each shaft in spaced relation such that the screen discs of the adjacent shafts interdigitate to carry material between the inlet and discharge ends of said frame, said discs cooperating to form a screen with open gaps between the screen discs for the fallout of objects sized to fit through said open gaps;

(d) a rotary shaft drive system operative to rotate all of said shafts in a common direction for transporting material from said bed frame inlet to said bed frame outlet; and (e) control means adjacent said outlet sensitive to the passage of fallout objects through said screen discs adjacent said outlet, said control means being operative for adjusting the speed of rotation of said rotary shafts for maximizing the screening efficiency independently of the quantity of incoming material and thereby at the same time controlling the residence time of material on said series of screen discs in movement between said bed frame inlet and outlet.

2. In a rotary disc screen having a bed frame extending from a material inlet to a material outlet, rotary shafts carried by the bed frame in spaced parallel relationship, a series of screen forming discs on each shaft interdigitating with discs on adjacent shafts for mutual cooperation to form a screen with open gaps between the discs for the fallout of objects sized to fit through such gaps, and a drive system operatively connected to said rotary shafts for effecting the transportation of material from the bed frame inlet to the bed frame outlet, the improvement therein comprising:

control means located adjacent said bed frame outlet and connected to said drvie system, said control means being sensitive to material fallout adjacent the bed frame outlet for adjusting the speed of the drive system for said rotary shafts, independently of the supply of material at the inlet whereby the fallout of material will be more efficiently distributed along the length of the rotary disc screen between the bed frame inlet and outlet ends by said sensitvie control means responding to the material fallout adjacent said bed frame outlet.

3. A method of separating out a certain class of components from a collection of waste material, the method comprising:

(a) providing a rotary screen having inlet and outlet ends spaced apart to support a collection of waste material between those ends;

(b) introducing the collection of waste material to the rotary screen at the inlet end;

(c) driving the rotary screen to move the collection of waste material toward the outlet ends over the rotary screen so the certain class of components falls out through the screen;

(d) sensing the fallout of the certain class of components adjacent the outlet end from the collection of waste material moved by the rotary screen;

(e) adjusting the speed of the rotary screen in response to fallout sensed adjacent the outlet end whereby to more evely distribute the waste material on the rotary screen and maximize the screening efficiency independently of the supply of material introduced at the inlet end; and (f) collecting the fallout components that are screened out of the collection of waste material separately from the remainder of the collection of waste material.

4. The method of claim 3 wherein controlling the speed of the rotary screen will determine the residence time of the collection of waste material on the rotary screen.

* * * * *